US008051757B2

(12) United States Patent
Maddalon

(10) Patent No.: US 8,051,757 B2
(45) Date of Patent: Nov. 8, 2011

(54) METHOD FOR CUTTING PAPER AND OTHER GRAPHIC SUPPORTS ON A ROLL AT THE SAME TIME ALONG TWO PERPENDICULAR AXES WITH AUTOMATIC CORRECTION OF ERRORS

(75) Inventor: Valter Maddalon, Pralungo (IT)

(73) Assignee: Fotoba International S.R.L., Quaregna Bi (IT)

( * ) Notice: Subject to any disclaimer, the term of this patent is extended or adjusted under 35 U.S.C. 154(b) by 354 days.

(21) Appl. No.: 12/445,402

(22) PCT Filed: Oct. 25, 2006

(86) PCT No.: PCT/IT2006/000753

§ 371 (c)(1),
(2), (4) Date: Apr. 13, 2009

(87) PCT Pub. No.: WO2008/050357

PCT Pub. Date: May 2, 2008

(65) Prior Publication Data

US 2010/0000382 A1 Jan. 7, 2010

(51) Int. Cl.
*B26D 7/26* (2006.01)
*B26D 5/34* (2006.01)

(52) U.S. Cl. ..... 83/34; 83/76.8; 83/210

(58) Field of Classification Search ..... 83/72, 74, 83/76.8, 364, 365, 367, 368, 948, 360, 370, 83/371, 33, 34, 35, 36, 209, 210, 211
See application file for complete search history.

(56) References Cited

U.S. PATENT DOCUMENTS

| | | | | |
|---|---|---|---|---|
| 4,358,978 | A * | 11/1982 | Lawson | 83/364 |
| 5,079,981 | A * | 1/1992 | Singer et al. | 83/72 |
| 5,586,479 | A * | 12/1996 | Roy et al. | 83/74 |
| 6,196,098 | B1 * | 3/2001 | Hagiwara et al. | 83/79 |
| 6,796,209 | B2 * | 9/2004 | Boss | 83/365 |
| 6,820,526 | B1 | 11/2004 | Maddalon | |
| 6,907,806 | B1 * | 6/2005 | Okamoto et al. | 83/76.8 |
| 2003/0033918 | A1 * | 2/2003 | Maddalon | 83/74 |
| 2004/0182211 | A1 * | 9/2004 | Maddalon | 83/74 |

FOREIGN PATENT DOCUMENTS

| | | | |
|---|---|---|---|
| EP | 0947880 | A1 | 10/1999 |
| WO | 01/76833 | A | 10/2001 |
| WO | 2006/126224 | A | 11/2006 |

* cited by examiner

*Primary Examiner* — Stephen Choi
(74) *Attorney, Agent, or Firm* — Lucas & Mercanti, LLP

(57) ABSTRACT

A method of cutting, simultaneously on two axes (X, Y) perpendicular to each other, of a sheet or web of paper and other graphic or photographic substrates (10) with series of images, comprising the steps of feeding forward the substrate sheet or web (10) to a direction (F), detecting the speed of sheet or web (10) feed and the speed at which the distance is varying between image reference marks (11) and the ideal feed direction, determining a correct cutting line ($T_X$) in a transverse direction to the feed direction (F) of the sheet or web by data processing according to trigonometric relations through a microprocessor to obtain the angle of parallelism defect of the image with respect to the ideal feed forward direction, aligning suitable mobile means (4) of transverse cutting with the desired cutting line ($T_X$) by means (5) for shifting the transverse cutting means.

7 Claims, 1 Drawing Sheet

Figure 1:
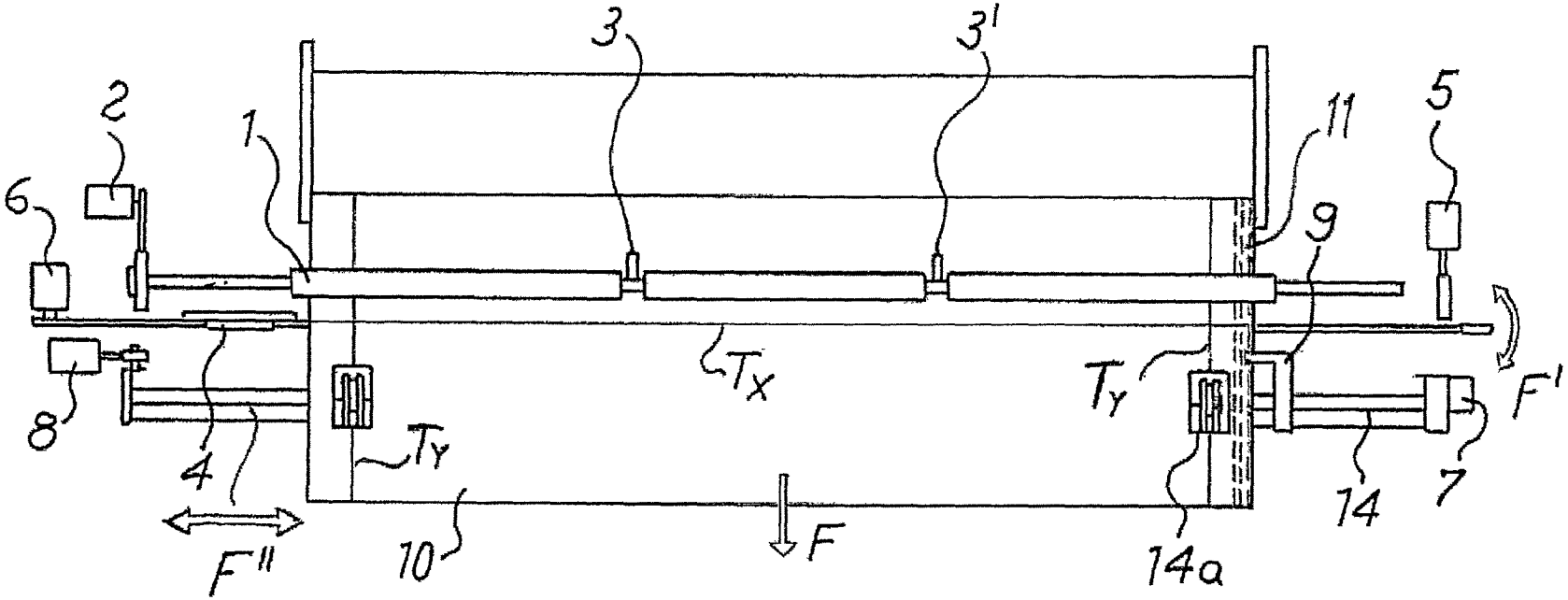

METHOD FOR CUTTING PAPER AND OTHER GRAPHIC SUPPORTS ON A ROLL AT THE SAME TIME ALONG TWO PERPENDICULAR AXES WITH AUTOMATIC CORRECTION OF ERRORS

The present invention relates to a method of automatic cutting, on two perpendicular axes simultaneously, of paper and other graphic substrates wound in roll, provided with automatic correction of errors due to skiddings of the substrate, particularly for substrates printed with digital rendering systems and for large formats, either provided with lateral reference marks, external to the image, or lacking any additional reference mark.

The technology of cutting such printed substrates has been limited to developing cutters being able to cut along the two axes, but having great limits. In particular it was impossible to correct skiddings of the roll, if badly re-wound, or inaccuracies due to the image itself, if printed not perfectly parallel to the edge of the substrate. Further, it was impossible to cut along the X-axis, parallel to the image in horizontal direction, if due to one or both the above-mentioned reasons, this side, when cut, is not perfectly at right angles with the paper cutter.

Due to the ever increasing market-penetration of the digital printing, which is replacing the offset technology thanks to its flexibility and reduced costs for short runs, there has been a great increase of the processed volumes, whereby the manual finishing is no more acceptable and it is thereby essential to automatize the finishing of the prints. In addition, while for small formats the consequences of possible skiddings of the roll or of the image can be unimportant, in large formats these are not acceptable and their correction becomes essential.

The co-pending international patent application PCT/IT2006/000198 in the name of the same applicant discloses a device allowing to make automatically a precise cutting of graphic substrates in roll, on both longitudinal and transverse directions, comprising a system for the correction of the cut direction depending on possible deviations of the substrate. However, with the device according to that application there is the need of providing reference marks on the graphic substrate, to be recognized by suitable optical sensors in order to determine the correction of the cutting path in a direction transverse to the forward movement of the graphic substrate, and standard lateral reference marks (two black bands and an intermediate white one) which can be detected by an optic cell to carry out the longitudinal cut at the correct locations.

An object of the present invention is thus to overcome the limits of the prior art for what concerns the possibility of obtaining the same result of substrate cutting without any need of reference marks, for cutting in a transverse direction to the forward movement of the substrate, or of standard lateral reference marks, external to the image, to carry out the cut in longitudinal direction.

This object is achieved with a cutting method having the characteristics specified at least in claim 1, with possible further aspects, optional or preferred, resulting from the dependent claims.

An advantage of the method according to the present invention is the possibility of detecting, as reference mark, very different kinds of delimitation lines between zones having a sufficient contrast with respect to each other, such as the image edge, when the contrast between the colour of substrate and that of the image edge is sufficient for the optic cell to detect the image edge itself, or the edge of the paper or substrate when it can be considered substantially parallel to the image edge.

Other objects, advantages and characteristics of the method according to the invention will result more clearly from the following detailed description with reference to a device suitable to carry out the method of the invention, as represented schematically by way of non-limiting example in FIG. 1.

The cutting method, simultaneously on two axes (X,Y) perpendicular to each other, according to the present invention comprises a step consisting in feeding forward in a direction F a web or sheet 10 of paper or other substrate being fed from a roll, such as by means of counter-rotating rollers 1.

FIG. 1 shows a device adapted to accomplish the cutting method according to the present invention, comprising a pair of rollers 1 (only the upper roller of which is shown) and a motor 2 for their drive, to feed forward a web or sheet 10, being fed by a roll in the direction of arrow F.

In another step of the method, suitable detecting means 9, such as an optic cell, detects the positioning of reference marks 11, being provided on the web 10 to determine the location where the cut in longitudinal direction $T_Y$ has to be made. In the method according to the present invention these reference marks 11 are delimitation lines between areas having a sufficient contrast with respect to each other. These delimitation lines may be lateral reference marks of various kind, such as single or multiple lines printed parallel to the image edge; may be the image edge itself when the contrast between the colour of the substrate web or sheet 10 and that of the image edge is sufficient for the detecting means 9 to detect the image edge; or may be the edge of the web or sheet 10 when it can be considered substantially parallel to the image edge.

In a subsequent step of the method suitable means 8 for shifting means 14, 14*a* of longitudinal cut are controlled by a microprocessor (not shown) in order to shift to a direction F", transverse to the direction F of feeding forward the web 10, the longitudinal cutting means 14, 14*a* and to render their position coincident with the correct direction of longitudinal cut $T_Y$.

The detecting means 9 can be e.g. mounted on the longitudinal cutting means 14, 14*a*.

In a preferred embodiment the longitudinal cutting means 14, 14*a* are formed of two or more rotating blades located above the substrate 10 to be cut and finished along cutting lines $T_Y$ provided for (there may be at least another cutting line at the center of substrate 10 when the images are printed in pairs in side-by-side relation along the X-axis). Said rotating blades 14*a*, being driven in any known way by a motor 7, are mounted at predetermined positions, according to the dimensions of the images to be cut, on a single shaft movable transversally and driven by shifting means 8, such as a motor.

Once determined the correct cut lines $T_Y$, a step of longitudinal cutting is carried out along said cut lines $T_Y$ by means of the above mentioned longitudinal cutting means 14, 14*a*.

In the cutting method according to the present invention the feed speeds of web 10 are detected as well the speed at which the distance varies-between the reference marks 11 of the image and the ideal feed direction, whereby the angle of parallelism defect is evaluated, through processing based on trigonometric relations, carried out by the microprocessor.

According to the present invention suitable mobile transverse cutting means 4 are brought into alignment with the correct cut line $T_X$ through means 5 for shifting the transverse cutting means 4 which are positioned at an angle, with respect to the feed direction, which is complementary to the angle of parallelism defect, i.e. perpendicularly to the longitudinal cutting direction $T_Y$.

The mobile means 4 of transverse cutting can be a unit of mobile cutting, which is driven by a motor 6 and brought into alignment with the desired cutting line $T_X$ by means of a motor 5, according to deviation signals provided by the microprocessor. Being so controlled, the motor 5 determines an angular shift of the cutting path, e.g. for the correction of an oblique trend. To this purpose, while an end of the sliding guide of the cutter 14 is movable in the double direction clockwise/counterclockwise of arrow F', under the action of the motor 5, the other end is stationary and advantageously serves as a pivot for the resulting rotation.

It will be noted that the above mentioned angular shift occurs simultaneously with the cutting or, based on stored data, always available, immediately before the cutting itself. Such a continuous availability of the correction data and substantial simultaneity between shift and cutting operation results to be a peculiar feature of the method of the invention.

The exact position where the horizontal cut is to be effected can be determined either by means of suitable sensors which detect the feed entity of web or sheet 10, or directly by the user of the device.

The cutting is carried out upon alignment of the cutting unit 4 with the transverse direction $T_X$ with respect to the forward feed direction F of the web.

Contrary to the prior art, according to the method of present invention the transverse direction cut can be obtained with an apparatus that does not comprise means 3, 3' for determining the cutting line $T_X$, suitable to determine a correct cutting line $T_X$ in a direction transverse to the web feed direction F by detecting one or more reference marks between two subsequent images on the substrate. Such an apparatus is for example described in the patent EP 0 951 973, wherein a pair of optical sensors 3,3' is in particular positioned in correspondence of two different cross-sections, having a reduced diameter, of the counter-rotating rollers, and can detect a mark (not shown) provided between two subsequent images printed on the web 10.

The invention claimed is:

1. A method of cutting, simultaneously on two axes perpendicular to each other, of a substrate with series of images, comprising the steps of:

feeding forward the substrate to a flow direction;

determining a correct cutting line in a transverse direction to the feed direction of the substrate;

aligning suitable transverse mobile cutting means with the cutting line by means for shifting the transverse mobile cutting means;

cutting the substrate in the transverse direction to the feed direction thereof by said transverse mobile cutting means;

detecting a position of reference marks on the transverse direction to the feed direction of the substrate by means of detecting means;

forwarding from the detecting means a direction signal to a microprocessor;

determining through the microprocessor correct cutting lines in a longitudinal direction with respect to the feed direction of the substrate;

controlling by the microprocessor by a shifting means to shift longitudinal cutting means in a direction transverse to the feed direction of the substrate;

cutting the substrate in the longitudinal direction along said cutting lines by said longitudinal cutting means;

wherein the step of controlling said shifting means is carried out as a function of speed at which the substrate is fed forward and of a speed at which a distance varies between a reference mark of an image and an ideal feed direction; and the step of determining a correct cutting line in the transverse direction to the feed direction of the substrate comprises the operations of:

detecting the speed at which the substrate is fed and the speed at which the distance varies between the reference mark of the image and the ideal feed direction; and determining a correct cutting line in a transverse direction to the feed direction of the substrate by data processing according to trigonometric relations by means of said microprocessor to obtain the angle of parallelism defect of the image with respect to the ideal feed forward direction.

2. The method of cutting according to claim 1, wherein each reference mark is delimitation line between zones having a sufficient contrast with respect to each other.

3. The method of cutting according to claim 1, wherein each reference mark is a single line or multiple lines printed parallel to an edge of the image.

4. The method of cutting according to claim 1, wherein each reference mark is an edge of the image when a contrast between a color of the substrate and a color of the edge of the image is sufficient for the detecting means to detect the edge of the image.

5. The method of cutting according to claim 1, wherein each reference mark is an edge of the substrate, when the image reference mark is substantially parallel to an edge of the image.

6. The method of cutting according to claim 1, wherein the shifting of the transverse mobile cutting means and the longitudinal cutting means takes place at a same time as the cutting step.

7. The method of cutting according to claim 1, wherein the shifting of the transverse mobile cutting means and the longitudinal cutting means takes place immediately before said cutting step, with correction data being continuously stored and available.

* * * * *